US007748709B2

(12) United States Patent
Schwarzbauer

(10) Patent No.: US 7,748,709 B2
(45) Date of Patent: Jul. 6, 2010

(54) DEVICE FOR ALIGNING FLAT OBJECTS BY WAY OF A SPINDLE THREAD

(75) Inventor: Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/178,853

(22) Filed: Jul. 24, 2008

(65) Prior Publication Data

US 2009/0026698 A1 Jan. 29, 2009

(30) Foreign Application Priority Data

Jul. 24, 2007 (DE) ..... 10 2007 034 391

(51) Int. Cl.
*B65H 9/12* (2006.01)

(52) U.S. Cl. ..... 271/241; 271/149

(58) Field of Classification Search ..... 271/179, 271/210, 250, 149, 150, 241
See application file for complete search history.

(56) References Cited

U.S. PATENT DOCUMENTS 3,995,851 A * 12/1976 Casper ..... 271/179
4,109,572 A 8/1978 Roulleau
4,252,308 A * 2/1981 Templeton ..... 271/179
4,884,795 A * 12/1989 Vander Syde ..... 271/34
5,064,093 A 11/1991 Davis et al.

FOREIGN PATENT DOCUMENTS

| | | | |
|---|---|---|---|
| DE | 2628338 | B2 | 7/1980 |
| DE | 2701471 | C2 | 4/1989 |
| DE | 195 40 992 | C2 | 4/1999 |
| EP | 0771748 | B1 | 5/1997 |
| GB | 1506111 | A | 4/1978 |

OTHER PUBLICATIONS

German Office Action dated Sep. 30, 2009.

* cited by examiner

*Primary Examiner*—Patrick Mackey
*Assistant Examiner*—Thomas A Morrison
(74) *Attorney, Agent, or Firm*—Laurence A. Greenberg; Werner H. Stemer; Ralph E. Locher

(57) ABSTRACT

A device for aligning flat objects, in particular mail items, has a base face, a side wall, and at least one spindle thread, which is let into the base face. The spindle thread is embodied to transport flat objects lying on the base face in a conveyance direction, thereby pushing them against the side wall. The spindle thread has at least one aligning region. Each aligning region is subdivided respectively into a decompression segment and a compression segment. The pitch of the spindle thread increases along the conveyance direction in each decompression segment and decreases in each compression segment.

4 Claims, 2 Drawing Sheets

DEVICE FOR ALIGNING FLAT OBJECTS BY WAY OF A SPINDLE THREAD

CROSS-REFERENCE TO RELATED APPLICATION

This application claims the priority, under 35 U.S.C. §119, of German application DE 10 2007 034 391.6, filed Jul. 24, 2007; the prior application is herewith incorporated by reference in its entirety.

BACKGROUND OF THE INVENTION

Field of the Invention

The invention relates to a device for aligning flat objects, in particular mail items. The mail items have to be aligned at two edges, before they are processed in a sorting unit.

A device of the general kind is described in German patent DE 19540992 C2. There, there is described a device with a base and a side wall. At least two rotatable spindle threads are let into the base and at least one is let into the side wall. The spindle thread is embodied to transport flat objects lying on the base face in a conveyance direction, thereby pushing them against the side wall. The pitch of the spindle threads increases when viewed in the transport direction, with the result that the mail items are moved apart.

SUMMARY OF THE INVENTION

It is accordingly an object of the invention to provide a device for aligning flat objects which overcomes the disadvantages of the heretofore-known devices and methods of this general type and which aligns flat objects reliably at the two aligning faces, even if the objects adhere to each other.

With the foregoing and other objects in view there is provided, in accordance with the invention, a device for aligning flat objects, such as flat mail items, comprising:

a base face and a side wall;

at least one spindle thread disposed in the base face and configured to transport flat objects supported on the base face in a conveyance direction and to thereby push the flat objects against the side wall;

the spindle thread having at least one aligning region defined with a decompression segment and a compression segment; and a pitch of the spindle thread, as viewed in the conveyance direction, increasing in each decompression segment and decreasing in each compression segment.

In other words, the device for aligning flat objects comprises a base face, a side wall and at least one spindle thread, which is let into the base face. The spindle thread is embodied to transport flat objects standing on the base face in a conveyance direction, thereby pushing them against the side wall. The spindle thread comprises at least one aligning region. Each aligning region is subdivided respectively into a decompression segment and a compression segment. The pitch of the spindle thread—when viewed in the conveyance direction—increases in each decompression segment and decreases in each compression segment.

In the at least one decompression segment the distance between a number of adjacent flat objects is enlarged. This causes the flat objects to be decompressed. Decompression in turn facilitates the alignment of the flat objects with the base face and side wall. In the at least one compression segment the distance between a number of adjacent flat objects is reduced. This prevents the objects tipping over.

The device preferably comprises in addition at least one vibration facility. This at least one vibrator (i.e., shaker) is embodied to align flat objects by vibration when the flat objects are above a decompression segment. In this decompression segment the distance between the objects is greater than in other segments, so the objects do not adhere or stick to one another. This allows vibration to bring about alignment quickly.

Other features which are considered as characteristic for the invention are set forth in the appended claims.

Although the invention is illustrated and described herein as embodied in device for aligning flat objects by means of a spindle thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiment the device is deployed to align flat mail items, e.g. letters and post cards. The mail items are combined to form a stack, in such a manner that the planes of the flat mail items are parallel to one another.

Figure 1:
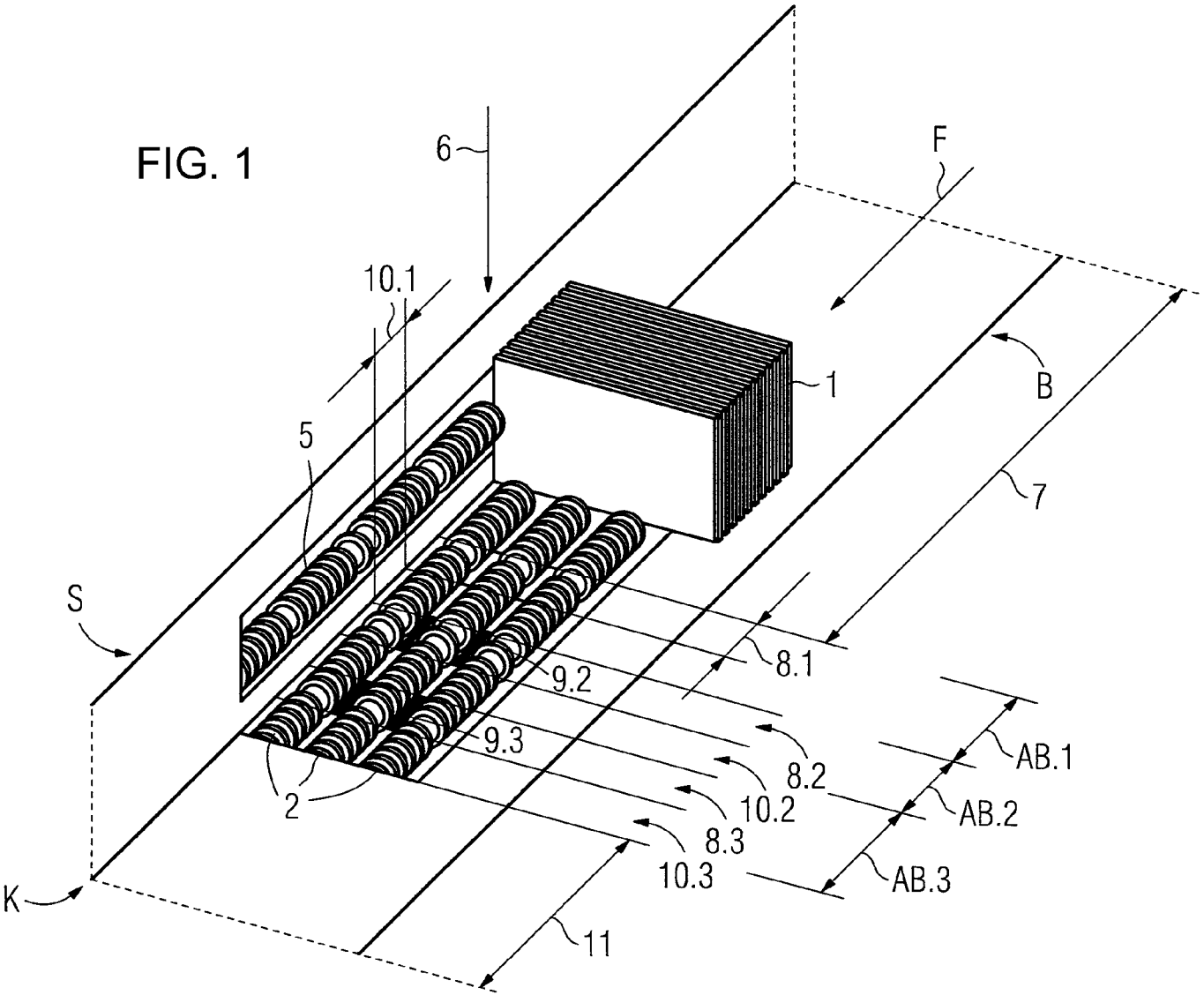
FIG. 1 is a diagrammatic perspective view of an exemplary embodiment of the aligning device according to the invention.

Referring now to the figures of the drawing in detail and first, particularly, to FIG. 1 thereof, a stack 1 of mail items to be aligned is conveyed from right to left in a conveyance direction F. The device comprises a horizontal base face B and a side wall S. The side wall S is perpendicular to the base face B. The base face B meets the side wall S in a horizontal edge K. The base face B can be arranged in a horizontal manner or can be inclined steeply toward the edge K. The base face B and side wall S function as the two aligning faces of the device.

In the exemplary embodiment three parallel spindle threads 2 are let into the base face B. One spindle thread 5 is let into the side wall S. All four spindle threads 2, 5 are supported so that they can be rotated about their respective longitudinal axes. The teeth of the four spindle threads 2, 5 engage between the mail items in the stack 1 and transport the mail items in the conveyance direction F—in the exemplary embodiment from right to left. The direction of rotation of the three spindle threads 2 in the base face B causes the mail items in the stack 1 to be pushed against the spindle thread 5 in the side wall S.

The rotation of the spindle thread 5 in the side wall S reciprocally causes the mail items in the stack 1, which are pushed against the spindle thread 5, to be pushed downward against the spindle thread 2 in the base face B.

The four spindle threads 2, 5 are preferably rotated synchronously and a a common (i.e., identical) speed. Their longitudinal axes run parallel to one another. This causes the mail items to be transported in a perpendicular manner or with an identical angle of inclination to the vertical.

The following parameters of a spindle thread are defined below:

The flank width refers to the width of a rectangular tooth of the spindle thread, viewed in the longitudinal direction of the spindle thread.

The gap is the distance between two adjacent rectangular teeth of the spindle thread, measured at the edges facing one another. That is, the gap is the free space between adjacent teeth.

The pitch is the distance between the center planes of two adjacent rectangular teeth.

The height of the spindle flanks is the difference between the radius of the spindle flanks and the radius of the spindle core (of a cylinder extending along the axis of rotation).

In the case of a constant pitch, the pitch is equal to the sum of the flank width and the gap.

In the exemplary embodiment the four spindle threads 2, 5 are subdivided into five regions lying one behind the other when viewed in the conveyance direction F.

In the example in FIG. 1 the first region 7 is concealed by the stack 1. In this first segment 7 the spindle threads 2, 5 have a constant and corresponding flank width and a constant and corresponding gap and pitch.

The stack 1 of mail items to be aligned is placed on the first region 7, for example manually by an operator or automatically by a grab. The stack pressure that the mail items exert on one another does not change while the stack 1 is transported in the region 7 in the conveyance direction F. This first region 7 is therefore also referred to as the loading region 7.

Adjacent to the loading region 7 are three aligning regions AB-1, AB-2 and AB-3. The first aligning region AB-1 is subdivided into a first decompression segment 8.1 and a first compression segment 10.1. The second aligning region AB-1 is subdivided into a second decompression segment 8.2 and a second compression segment 10.2. The third aligning region AB-3 is subdivided into a third decompression segment 8.3 and a third compression segment 10.3.

The mail items in the stack 1 are decompressed in the three decompression segments 8.1, 8.2 and 8.3. The pitch of the spindle threads 2, 5 increases continuously or even abruptly—when viewed in the conveyance direction F—in the three decompression segments 8.1, 8.2 and 8.3. This is caused by an increasing gap and/or an increasing flank width, preferably by an increasing gap and increasing pitch with a constant flank width. The increasing pitch causes the decompression of the mail items. Once the mail items have passed through one of the decompression regions 8.1, 8.2, 8.3 they practically no longer adhere to one another.

A first compression segment 10.1 is adjacent to the first decompression segment 8.1. A second compression segment 10.2 is adjacent to the second decompression segment 8.2. A third compression segment 10.3 is adjacent to the third decompression segment 8.3.

In these three compression segments 10.1, 10.2 and 10.3 the mail items are pushed back together again. Compression is brought about in that the gap and/or the flank width of all four spindle threads 2, 5 decreases again when viewed in the conveyance direction F. The flank width preferably remains constant and the gap decreases when viewed in the conveyance direction F. In the compression segments 10.1, 10.2 and 10.3 the gap however preferably remains larger than in the loading region 7.

The compression segments 10.1, 10.2 and 10.3 are preferably shorter—when viewed in the conveyance direction F—than the decompression segments 8.1, 8.2 and 8.3. The decompression segments 8.1, 8.2 and 8.3 are in turn each shorter than the loading region 7.

Adjacent to the third compression segment 10.3 is a fifth region 11, in which the aligned mail items are transported away for further processing. The fourth region is therefore also referred to as the transport region 11.

The height of the spindle flanks is limited in an upward direction by the offset between the mail items perpendicular to the conveyance direction F, which is permissible as a maximum for these after alignment. This maximum permissible offset is predetermined by subsequent processing steps.

In one embodiment the outer faces of the spindle flanks are configured to fall away in the conveyance direction F or are embodied as roof-shaped, to prevent a mail item remaining on the outside of a spindle flank and no longer passing between two spindle flanks and no longer being transported further.

The mail items are in particular aligned by being vibrated. In the exemplary embodiment the mail items are not vibrated over the entire conveyance section but just in the decompression segments 8.1, 8.2 and 8.3. In these decompression segments 8.1, 8.2 and 8.3 the mail items practically do not adhere to one another. Compression of the mail items in the respectively following compression segment 10.1, 10.2, 10.3 prevents the aligned mail items from falling or tipping over.

In the decompression segments 8.1, 8.2 and 8.3 a vibration facility 9.1, 9.2 and 9.3 is located respectively in the base face B and between the three spindle threads 2. The vibration facilities 9.1, 9.2 and 9.3 preferably induce the vibration forces in the surfaces of the mail items, to prevent a mail item being damaged. Each transported flat mail item comes into contact one after the other with the vibration facilities 9.1, 9.2 and 9.3 along an entire edge. The vibration facilities 9.1, 9.2 and 9.3 preferably generate a vibration force, which comprises one force component parallel to the conveyance direction F and one further force component perpendicular to the conveyance direction F. Both force components act on the mail item. In one embodiment the vibration facilities 9.1, 9.2 and 9.3 move at an angle of respectively 45 degrees to the base face B and to the side wall S and at an angle of 90 degrees to the conveyance direction F.

The compression segments 10.1, 10.2, 10.3 prevent the mail items falling over when being vibrated and therefore aligned in the decompression region 8. There is a particular risk of falling over if the mail items are not positioned perpendicular to the base face B in the loading region 7, because an angled position increases in the decompression segments 8.1, 8.2 and 8.3 as a function of the decompression factor.

The device—when viewed in the conveyance direction F—preferably first comprises a loading region 7, then a number of decompression segments 8.1, 8.2 and 8.3 and compression segments 10.1, 10.2 and 10.3 and then a transport region 11. A compression segment **10.*n* respectively follows each decompression segment 8.*n* so that—when viewed in the conveyance direction F—the first decompression segment 8.1 is adjacent to the loading region 7 and the transport region 11 is adjacent to the last compression segment 10.3. In one embodiment the device comprises five aligning regions and therefore five decompression segments and five compression segments. FIG. 1 shows three decompression segments 8.1, 8.2 and 8.3 and three compression segments 10.1, 10.2 and 10.3**.

In the loading region the spindle thread 2 has a pitch with the value pitch_1. In the decompression segment 8.1 the pitch increases from a value pitch_1 to a value pitch_2. The pitch preferably increases continuously.

Figure 2:
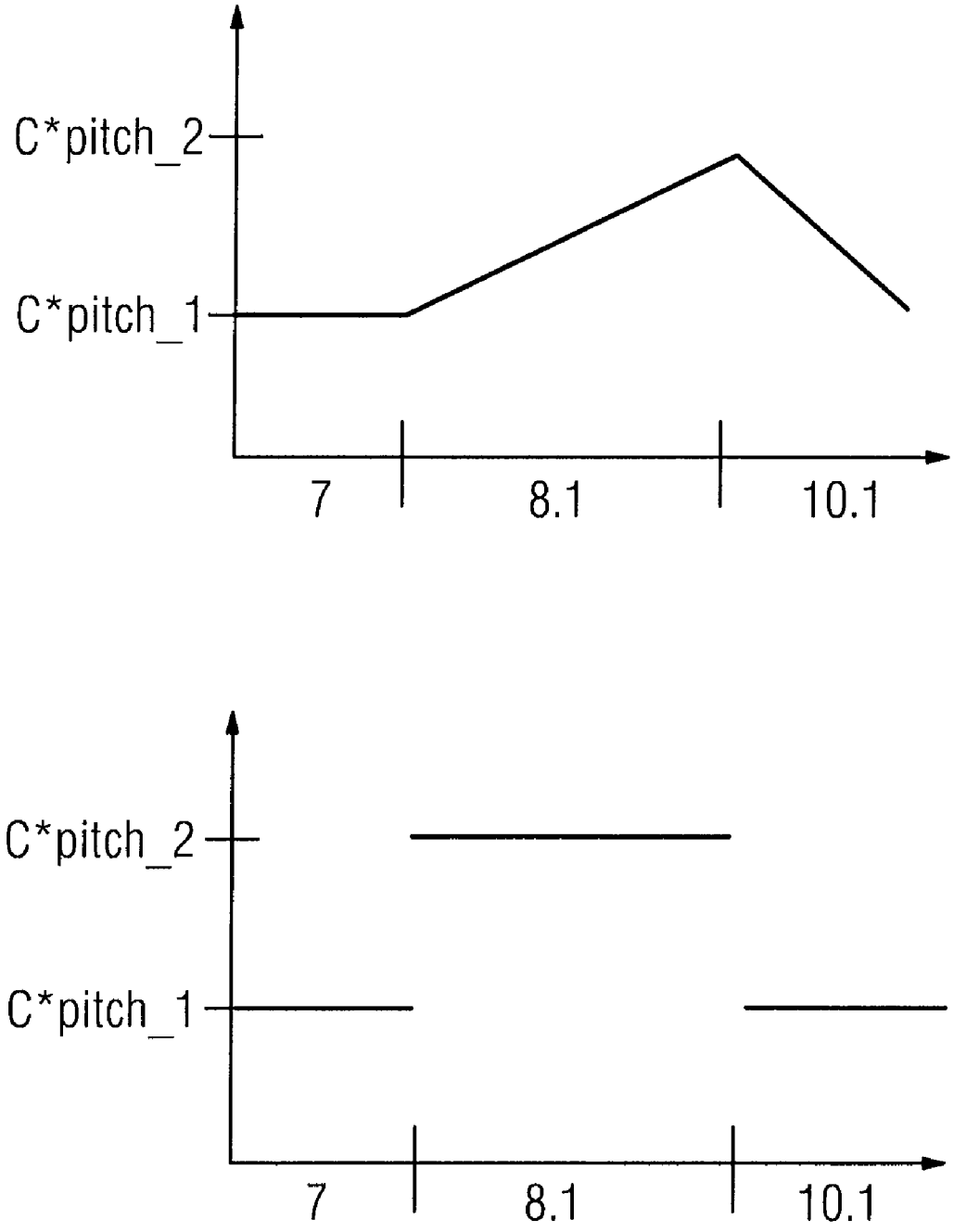
FIG. 2 are two graphs showing a continuous and an abrupt transition from a smaller to a larger pitch, respectively.

The top diagram in FIG. 2 shows a continuous transition and the bottom diagram shows an abrupt transition from the smaller pitch pitch_1 to the larger pitch pitch_2. The x-axis shows the pitch as a function of the distance already covered in the conveyance direction F. The y-axis shows the conveyance speed achieved. This conveyance speed is equal to the product of a factor C and the pitch.

The continuous transition brings about better separation of the mail items. A spindle thread with an abrupt transition is however easier to manufacture, because the spindle thread can be made from two parts, which are manufactured separately. The bottom diagram in FIG. 2 shows the abrupt transition.

The invention claimed is:

1. A device for aligning flat objects, comprising:

a base face;

a side wall;

at least one spindle thread disposed in said base face and configured to transport flat objects supported on said base face in a conveyance direction and to thereby push the flat objects against said side wall;

said at least one spindle thread having a plurality of aligning regions disposed one behind the other in the conveyance direction and each of said aligning regions being respectively subdivided into a decompression segment and a compression segment; and a pitch of said at least one spindle thread, as viewed in the conveyance direction, increasing in each decompression segment and decreasing in each compression segment.

2. The device according to claim 1 configured to align and transport flat mail items.

3. The device according to claim 1, which further comprises at least one vibration facility configured to align the flat objects by vibration while the flat objects are located above a respective decompression segment.

4. The device according to claim 1, wherein:

a loading region is defined ahead of said plurality of aligning regions, as viewed in the conveyance direction; and said at least one spindle thread is formed with a constant pitch in said loading region.

* * * * *